US005114562A

United States Patent [19]

Haun et al.

[11] Patent Number: 5,114,562

[45] Date of Patent: May 19, 1992

[54] TWO-STAGE HYDRODESULFURIZATION AND HYDROGENATION PROCESS FOR DISTILLATE HYDROCARBONS

[75] Inventors: Edward C. Haun, Glendale Heights; Gregory J. Thompson, Waukegan; Jayant K. Gorawara, Mundelein; Dana K. Sullivan, Mt. Prospect, all of Ill.

[73] Assignee: UOP, Des Plaines, Ill.

[21] Appl. No.: 562,172

[22] Filed: Aug. 3, 1990

[51] Int. Cl.[5] ..... C10G 65/12

[52] U.S. Cl. ..... 208/89; 208/88; 208/59; 208/143; 208/229

[58] Field of Search ..... 208/59, 89, 143, 229

[56] References Cited

U.S. PATENT DOCUMENTS

| | | | |
|---|---|---|---|
| 2,671,754 | 3/1954 | DeRossett et al. | 196/28 |
| 3,356,608 | 12/1967 | Franklin | 208/212 |
| 3,365,388 | 1/1968 | Scott, Jr. | 208/59 |
| 3,592,758 | 7/1971 | Inwood | 208/89 |
| 3,617,502 | 11/1971 | Stolfa | 208/89 |
| 3,673,078 | 6/1972 | Kirk, Jr. | 208/89 |
| 3,733,260 | 5/1973 | Davies et al. | 208/212 |
| 3,841,995 | 10/1974 | Bertolacini | 208/89 |
| 3,899,543 | 8/1975 | Cosyns et al. | 208/89 |
| 4,169,040 | 9/1979 | Bea et al. | 208/59 |
| 4,801,373 | 1/1989 | Corman | 208/89 |
| 4,954,241 | 9/1990 | Kukes et al. | 208/89 |

OTHER PUBLICATIONS

R. M. Nash, "Refining/Gas Processing Technology", *Oil and Gas Journal*, May 29, 1989, pp. 47-63.

*Primary Examiner*—Helane Myers

*Attorney, Agent, or Firm*—Thomas K. McBride; John F. Spears, Jr.

[57] ABSTRACT

Middle distillate petroleum streams are hydrotreated to produce a low sulfur and low aromatic product in a process employing two reaction zones in series. The effluent of the first reaction zone is purged of hydrogen sulfide by hydrogen stripping and then reheated by indirect heat exchange. The second reaction zone employs a sulfur-sensitive noble metal hydrogenation catalyst. Operating pressure and space velocity increase and temperature decreases from the first to second reaction zones.

12 Claims, 1 Drawing Sheet

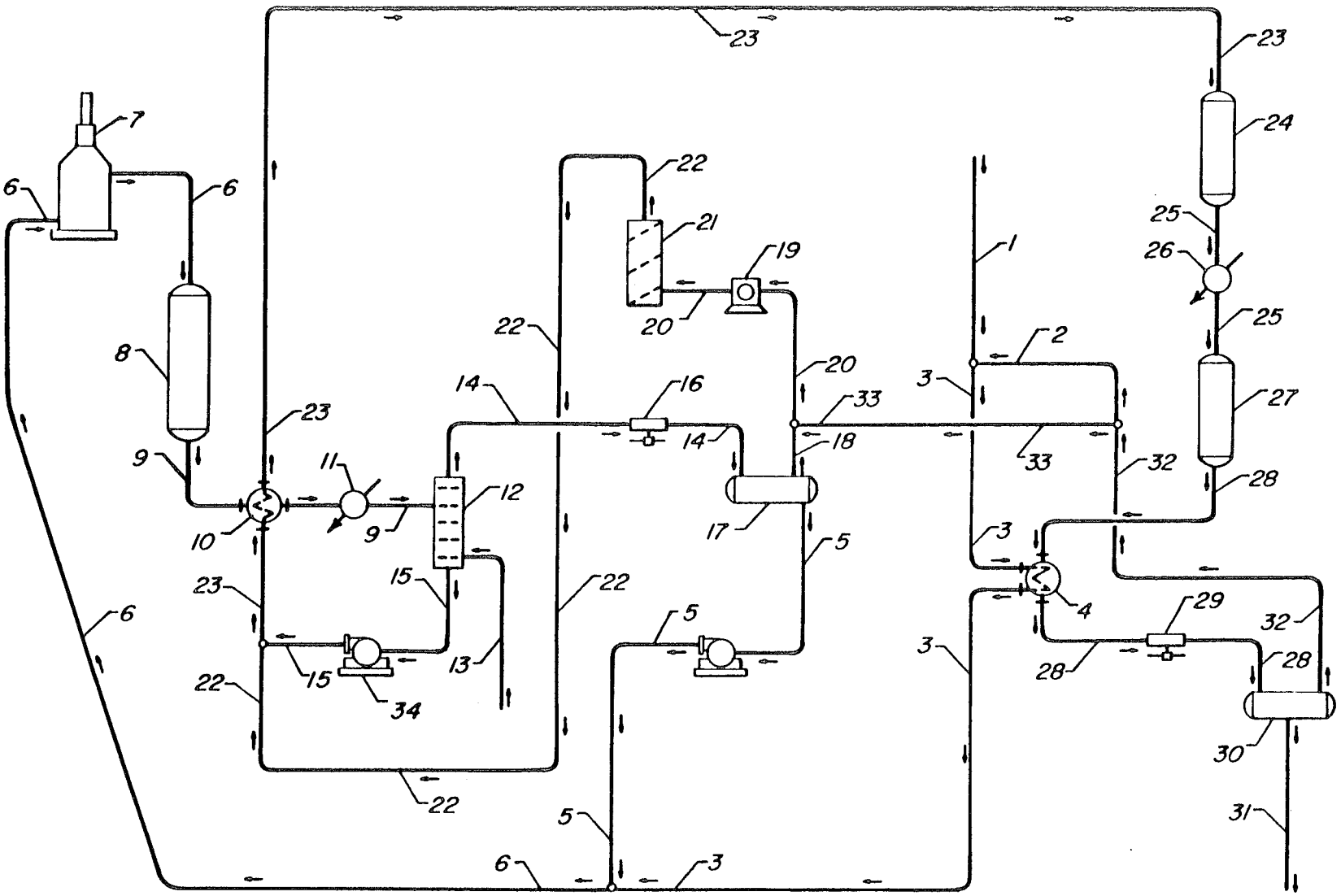
23
24
25
26
27
28
29
30
31
32
33
1
2
3
4
5
6
7
8
9
10
11
12
13
14
15
16
17
18
19
20
21
22
34

TWO-STAGE HYDRODESULFURIZATION AND HYDROGENATION PROCESS FOR DISTILLATE HYDROCARBONS

FIELD OF THE INVENTION

The invention is a mineral oil conversion process which includes hydrodesulfurization and hydrogenation steps performed in separate reaction zones. The subject invention specifically relates to the hydrogenation of distillate petroleum fractions to produce low sulfur content and low aromatic hydrocarbon content products including diesel fuel and jet fuel.

PRIOR ART

Quality specifications for petroleum products generally include a maximum sulfur content. In addition, the sulfur content of motor fuels is governed by pollution control statutes. There has therefore been a historical need to reduce the sulfur content of both light and heavy petroleum fractions. The need for such desulfurization is increasing due to more rigid sulfur content specifications and the increasing need to limit sulfur oxide emissions into the atmosphere. More recent standards limit, or will limit, the maximum aromatic hydrocarbon content of diesel fuel. Accordingly, there has been developed a significant body of literature dealing with the desulfurization and hydrogenation of petroleum fractions such as kerosene and diesel fuel, by catalytic hydrotreating.

U.S. Pat. No. 2,671,754 issued to A. J. DeRosset et al. is believed pertinent for its showing of an overall refinery process flow in which a hydrocarbon stream recovered from a fluidized catalytic cracking (FCC) unit is processed to reduce its sulfur content and olefinicity prior to recycling to the FCC unit. This hydrocarbon stream is subjected to sequential hydrodesulfurization and hydrogenation reaction steps. The reference teaches a non-noble metal can be employed for desulfurization and a noble metal catalyst for hydrogenation. The effluent of the hydrodesulfurization reaction step is subjected to cooling and hydrogen stripping to prepare liquid for passage into the hydrogenation reaction zone.

U.S. Pat. No. 3,356,608 is believed pertinent for its showing of a hydrotreating process designed to produce a low sulfur gas oil in which the product hydrocarbon stream is recovered from the reaction zone and passed into a stripper 117 in which it is countercurrently contacted with high temperature steam to remove hydrogen sulfide overhead. U.S. Pat. No. 3,365,388 issued to J. W. Scott, Jr. is believed pertinent for its showing of the passage of the liquid phase effluent of a hydrocarbon conversion reactor into a catalytic hot stripper in which the liquid passes downward over a catalytic material countercurrent to rising hot hydrogen-containing gas.

U.S. Pat. No. 3,673,078 issued to M. C. Kirk, Jr. is believed pertinent for its teaching of a lube oil distillate hydrogenation and desulfurization process wherein the feedstock is passed downward over a platinum on alumina catalyst countercurrent to rising hydrogen The first stage catalyst may be substantially sulfur resistant while a second stage catalyst may contain a more active aromatics saturation catalyst-containing platinum. Countercurrent hydrocarbon-hydrogen flow is employed to reduce the sulfur content in the reaction zone containing the more sulfur sensitive platinum-containing catalyst. In FIG. 3 hydrocarbons from a first reaction zone are passed into an $H_2S$ stripper for countercurrent contacting with steam to prepare the hydrocarbons for passage into a second reaction zone.

U.S. Pat. No. 3,733,260 issued to J. A. Davies et al. is believed pertinent for its showing of the effluent of a hydrodesulfurization reaction zone being subjected to vapor-liquid separation steps with the liquid phase effluent material then being passed into a stripping zone wherein it is contacted with hot hydrogen. The hydrogen stripping gas is treated to remove hydrogen sulfide. The stripped liquid is subsequently passed into the product fractionation column.

U.S. Pat. No. 4,169,040 issued to D. A. Bea et al. is believed pertinent for its showing of the production of a middle distillate oil by a two-stage hydrotreating process designed to have minimum production of lighter hydrocarbons. The reference is also believed pertinent for illustrating the scrubbing of the recycle hydrogen stream recovered from a reactor effluent to remove hydrogen sulfide. This reference is further believed pertinent for its detailed description of processing conditions suitable for the production of middle distillate oil.

U.S. Pat. No. 3,592,758 issued to T. V. Inwood is believed pertinent for its teaching in regard to the use of a noble metal (platinum) catalyst for the hydrogenation of distillate hydrocarbons in the presence of some hydrogen sulfide and for its two-stage process with a noble metal catalyst in the second stage.

An article by R. M. Nash appearing at page 47 of the May 29, 1989 edition of the *Oil and Gas Journal* is believed pertinent for its description of the process conditions necessary for the desulfurization of light cycle oils or similar feedstocks. This reference is also believed pertinent for its general teaching on the tendency for feedstock sulfur to inhibit aromatics saturation, needed reaction conditions to perform the desired aromatics saturation and the effect of many variables upon the operating conditions required to achieve a desired degree of feedstock treatment.

BRIEF SUMMARY OF THE INVENTION

The invention is a multireaction zone process for the production of low aromatics, low sulfur jet fuel or diesel fuel. The subject process employs two reaction zones, one for desulfurization and one for hydrogenation, in a series flow arrangement and is characterized by a unique hydrogen flow combined with the hydrogen stripping of the effluents of the first reaction zone to remove hydrogen sulfide. Temperature and pressure integration allow stripping to be used in a very economical manner.

The subject process is also characterized by the use of a noble metal catalyst in the hydrogenation zone and by an ascending pressure gradation and descending temperature gradation from the first to second reaction zone.

One embodiment of the invention may be broadly characterized as a hydrotreating process which comprises the steps of passing a stream of middle distillate charge stock into the first of at least two reaction zones and producing a first reaction zone effluent, the two reaction zones comprising a firs catalytic reaction zone containing a fixed bed of solid desulfurization catalyst comprising a non-noble metal active component chosen from the group comprising cobalt, molybdenum, nickel and tungsten and maintained at desulfurization conditions, and a second reaction zone containing a fixed bed of hydrogenation catalyst comprising a platinum group active component and maintained at hydrogenation conditions; separating the first reaction zone effluent into liquid and vapor fractions, and stripping the liquid fraction with hydrogen in a stripping zone to produce a first stripping zone gas stream; removing hydrogen sulfide from the first stripping zone net gas stream, passing the first stripping zone net gas stream into the second reaction zone; passing the liquid fraction of the effluent of the first reaction zone into the second reaction zone and producing a second reaction zone effluent; and, passing a portion of hydrogen-rich gas separated from the second reaction zone effluent into both the first and the second reaction zone, and recovering a reduced aromatic hydrocarbon content product stream from the effluent of the second reaction zone.

BRIEF DESCRIPTION OF THE DRAWING

The Drawing is a simplified process flow diagram illustrating a preferred embodiment of the subject invention. Feed hydrocarbons enter via line 1 and pass sequentially through reactors 8, 24, and 27 with product hydrocarbons being removed in line 31. Hydrogen from reaction zone 8 flows through stripping zone 12 and treating zone 21 into the reactor 24, with hydrogen recovered from the reactor 24 being passed into both the reactor 8 and treating zone 21.

DETAILED DESCRIPTION

The middle distillate products, such as diesel fuel, jet fuel, kerosene and gas oils, used as motor fuel or heating oil normally contain a significant amount of sulfur and aromatic hydrocarbons when recovered from basic refinery, fractionation or conversion units. The production of environmentally acceptable fuels or the production of low sulfur petrochemical feedstocks requires the removal of this sulfur down to low levels. The proposed standards for motor fuels will require the reduction of the aromatic content of diesel fuel. It is an objective of the subject invention to provide a process for the desulfurization and partial aromatic saturation of distillate hydrocarbons. It is a specific objective of the invention to provide an economical relatively low pressure process for the production of environmentally acceptable low aromatics content diesel fuel.

The subject process is especially useful in the treatment of middle distillate fractions boiling in the range of about 300°-700° F. (149°-371° C.) as determined by the appropriate ASTM test procedure. The subject process also has utility in the treatment of lighter distillates such as those boiling in the naphtha boiling point range. For instance, the process may be used to produce hydrocarbons for use in solvents, additives or even some fuels which preferably contain a reduced amount of aromatic hydrocarbons. These feed streams could contain a hydrocarbon mixture having a boiling point range extending below 149° C. The process may therefore be used for distillates boiling from about 140° C. to 380° C.

The kerosene boiling range is intended to refer to about 300°-450° F. (149°-232° C.) and diesel boiling range is intended to refer to about 450°-about 700° F. (232°-371° C.). Gasoline is normally the $C_5$ to 400° F. (204° C.) endpoint fraction of available hydrocarbons. A gas oil fraction will normally have a boiling range between about 320° to about 420° C. A heavy gas oil will have a boiling point range between about 420° to about 525° C. The boiling point ranges of the various product fractions will vary depending on specific market conditions, refinery location, etc. It is not uncommon for boiling point ranges to differ or overlap between refineries.

The feedstock could include virtually any middle distillate. Thus, such feedstocks as heavy naphtha, straight run diesel, jet fuel, kerosene or gas oils, vacuum gas oils, coker distillates, and cat cracker distillates could be processed in the subject process. The feed to the subject process can be derived from a catalytic hydrocracking process or a fluidized catalytic cracking (FCC) process. It is greatly preferred that the feedstock is a middle distillate rather than a heavy distillate or residue such as vacuum resid or a demetallized oil. The preferred feedstock will have a boiling point range starting at a temperature above about 180° Celsius and would not contain appreciable asphaltenes. Feedstocks with 90 percent boiling points under about 700° F. (371° C.) are preferred. The feedstock may contain nitrogen usually present as organonitrogen compounds in amounts between 1 ppm and 1.0 wt. %. The feed will normally contain sulfur-containing compounds sufficient to provide a sulfur content greater than 0.15 wt. % and often in the range of 0.8-3.2 wt. %. It may also contain mono- and/or polynuclear aromatic compounds in amounts of 20 volume percent and higher.

Preferred feedstocks have a $C_7$ insoluble content less than 0.1 and a Diene value of less than one.

Desulfurization conditions employed in the subject process are those customarily employed in the art for desulfurization of equivalent feedstocks. The preferred mode of operation includes relatively moderate process conditions as only a very limited amount of cracking is desired and it is also desired to provide a process which is not as expensive as high pressure hydrotreating processes. The operating conditions preferably result in a decreasing temperature gradation and an increasing pressure gradation from the first to last reaction zone. Desulfurization reaction zone operating temperatures are in the broad range of 400° to 1200° F. (204°-649° C.), preferably between 600° and 950° F. (316°-510° C.). Temperatures above 670° F. (354° C.) are especially preferred. Reaction zone pressures are in the broad range of about 400 psi (2758 kPa) to about 3,500 psi (24,233 kPa), preferably the hydrogen partial pressure is between 500 and 1500 psi (3450-10,340 kPa). Contact times usually correspond to liquid hourly space velocities (LHSV) in the range of about 0.2 $hr^{-1}$ to 6.0 $hr^{-1}$, preferably between about 0.2 and 4.0 $hr^{-1}$. The space velocity is highly dependent upon the feedstock composition. A naphtha with low sulfur will be processed in the higher portion of this range. The space velocity in the first reaction zone is preferably much less than those employed in the second reaction zone. Hydrogen circulation rates are in the range of 400 for light naphthas to 20,000 standard cubic feet (scf) per barrel of charge (71-3,560 std. $m^3/m^3$) for cycle oils, preferably between 1,500 and 5,000 scf per barrel of charge (266-887 std. $m^3/m^3$).

Passage of the feed through the desulfurization reaction zone will reduce the average molecular weight of the feed stream hydrocarbons resulting in the production of some lighter but valuable by-products including gasoline and LPG. The hydroprocessing reactions of hydrodenitrification and hydrodesulfurization will occur simultaneously with this very limited hydrocracking of the feedstock. This leads to the production of hydrogen sulfide and ammonia and their presence in the hydrodesulfurization zone effluent stream. Some of the reduction in the average molecular weight of the hydrocarbons being processed can be directly attributed to the desulfurization and/or denitrification, which can result in the cracking of the feed molecule at the location of a sulfur or nitrogen atom.

The subject invention achieves both good desulfurization of the chargestock plus a high degree of aromatics saturation. In the subject process two separate reaction zones are employed with series flow of the hydrocarbon material through these reaction zones. The hydrogen flow is not cocurrent with the hydrocarbon flow. A first portion of the hydrogen recovered from the second zone is recycled to the second zone. This recycling can be done via scrubbing to remove hydrogen sulfide. However, with a low hydrogen sulfide content it could be recycled without scrubbing. The recycle compressor may be located downstream of the scrubbing zone and the first portion of the recovered gas would flow directly to the compressor. A second portion is passed to the first (desulfurization) zone. In the subject process the first reaction zone is intended to provide a high degree of desulfurization and operates with hydrogen sulfide present in the gas streams passing through the reactor. The second reaction zone is intended to provide a high degree of aromatics saturation and preferably operates with at most a minimal amount of free H2S present in the reactants.

The hydrocarbons leaving the first reaction zone is subjected to countercurrent stripping with hydrogen to remove hydrogen sulfide prior to passage into the next reaction zone. The gases recovered from the effluent of the first reaction zone, together with hydrogen employed for stripping, is scrubbed for the removal of hydrogen sulfide and passed into the second reaction zone. The hydrogen stream passing into the second reaction zone is therefore substantially free of hydrogen sulfide. This results in the catalyst present in this reaction zone having a higher activity for aromatics hydrogenation. As described below, the subject process facilitates this stripping.

Another advantage of the subject invention is that it provides the highest operating pressure, and highest hydrogen partial pressure in the last reaction zone. The aromatics saturation reaction is more difficult to perform at the preferred conditions than desulfurization and also benefits the most from the higher pressure in the hydrogenation reactor. The subject invention provides a pressure which can be up to 5 atmospheres greater in the hydrogenation reaction zone than at the outlet of the desulfurization reaction zone. This is due in part to the recycle compressor being located immediately upstream of the hydrogenation zone. The process flow also allows independent control of the gas rate to each reaction zone in a very cost efficient manner.

Preferably the first reaction zone employs a desulfurization catalyst comprising nickel and molybdenum or cobalt and molybdenum on a support such as alumina while the second reaction zone contains a noble metal hydrogenation catalyst such as a catalyst comprising platinum or palladium on alumina.

The overall flow of the subject process may be understood by reference to the drawing. The drawing has been simplified by the deletion of many pieces of process equipment of customary design such as control systems and valves. The process depicted in the drawing is intended to produce high-quality diesel fuel. A feedstream comprising a heavy diesel boiling range distillate fraction enters the process through line 1 and is admixed with a first hydrogen-rich gas stream carried by line 2. This mixture continues through line 3 and the feed-effluent heat exchange means 4 wherein it is heated by indirect heat exchange against the effluent of the second reaction zone. The thus heated admixture of hydrogen and feed hydrocarbons continues through line 3 and is admixed with a small stream of hydrocarbons from line 5. The hydrocarbons of line 5 comprise an optional internal recycle stream. The admixture of hydrocarbons and hydrogen flows through line 6 into the fired heater 7 and then into the first (desulfurization) reaction zone 8.

The first reaction zone 8 may comprise a single unitary vessel comprising one or more beds of a solid desulfurization catalyst as shown on the drawing. However, the low space velocity of this zone may lead to the use of large quantities of catalyst which are more economically contained in two or more separate reactor vessels. The desulfurization zone is maintained at conditions suitable for the desulfurization of the feed hydrocarbons. There is thereby produced a desulfurization reaction zone effluent stream carried by line 9 which comprises an admixture of residual hydrogen, hydrogen sulfide, desulfurized and unconverted feed hydrocarbons, and by-products of the desulfurization reaction including some naphtha boiling range materials and light materials such as methane, ethane, propane, butane and pentane. The effluent stream of the first reaction zone 8 is first cooled by indirect heat exchange in the feed-effluent heat exchange means 10 and is then further cooled in the indirect heat exchange means 11. This heat exchanger may transfer heat through a different process stream or reject heat to air, cooling water or a steam generator.

The effluent stream of the desulfurization zone 8 is then passed into the stripping zone 12 at a reduced temperature as compared to the exit of the first reaction zone. The entering mixed phase material separates in an upper portion of the stripping zone 12 into a descending liquid phase and a rising vapor phase. The descending liquid phase comprises substantially all of the product diesel fuel boiling range hydrocarbons. Initially dissolved in this liquid phase stream are light hydrocarbons and hydrogen sulfide produced in the first reaction zone. A stream of hydrogen-rich gas is fed into a bottom portion of the stripping zone through line 13. This can be a hydrogen make-up gas stream for the process and is referred to herein as the second hydrogen stream. This hydrogen stream passes upward countercurrent to the descending hydrocarbons, which are expected to be at a relatively warm temperature above 100 degrees C. (212 degrees F.). The countercurrent contacting of the hydrogen and hot hydrocarbons results in the transfer of a very large percentage of the hydrogen sulfide present in the descending liquid into the rising vapor stream. The hydrogen sulfide is therefore largely removed from the liquid prior to its withdrawal through line 15 from the stripping zone.

The vapor phase portion of the reaction zone effluent stream together with the rising hydrogen stream carrying entrained hydrogen sulfide are withdrawn from the top of the stripping zone through line 14 and passed through a cooling means 16. This results in a partial condensation of the materials flowing through line 14. The material from line 14 enters the low pressure vapor-liquid separation zone 7 wherein it is separated into a vapor phase stream comprising hydrogen and hydrogen sulfide plus some light hydrocarbons such as methane, ethane, and propane and a liquid phase which is withdrawn through line 5. The liquid phase material collected in the separator 17 will contain a majority of the relatively small amount of hydrocarbons which were in the vapor at the conditions present at the top of the stripping zone 12.

The hydrocarbon fraction collected in the separator 17 will be somewhat lighter than the liquid phase material removed from the stripping zone through line 15. Accordingly, it could be passed into a downstream product separation facility such as the product recovery section not shown on the drawing by passage into line 31. However, it is preferably passed into the first reaction zone 8 via line 5 to ensure its complete desulfurization.

The vapor phase stream withdrawn from the vapor-liquid separator 17 through line 18 is pressurized in the compressor 19 and passed into the bottom of the treating zone 21. Compressor 19 operates as the recycle compressor of the process. In this zone the gas rises countercurrent to a stream of treating liquid fed to an upper portion of the treating zone. This treating zone may comprise an absorption column with the rising gases passing upward countercurrent to an aqueous amine solution which removes acid gases including hydrogen sulfide. This produces a hydrogen sulfide-rich liquid stream which is removed from the bottom of the treating zone 21 and a treated hydrogen-rich gas stream which is removed from the top of the treating zone via line 22. The treated gas of line 22 is substantially free of hydrogen sulfide.

The gas stream of line 22 is combined with the stripped liquid hydrocarbons of line 15 and passed through the feed-effluent heat exchange means 10 via line 23. The thus heated hydrogen-hydrocarbon admixture is carried by line 23 to the inlet of the second reaction zone, which is also referred to herein as the hydrogenation zone. The hydrogenation zone preferably contains one or more fixed beds of a solid catalyst comprising a noble metal on an inorganic oxide support. The hydrogenation zone is maintained at conditions effective to result in the saturation of a substantial portion of the aromatic hydrocarbons present in the entering materials. The hydrogenation reaction zone is operated with a very low hydrogen sulfide reactant concentration. This reaction zone is operated at the lowest temperature and highest pressure of the two reaction zones used in the process. It therefore is at a higher pressure and lower inlet temperature than reactor 8. In this instance the catalyst of the second reaction zone is divided between two separate vessels 24 and 27 with interstage cooling by indirect heat exchanger 26 in line 25 for steam generation. A single vessel could be employed and cooling could be provided in other ways, as by hydrogen quench injected into the reaction zone.

It is totally undesired to perform any significant cracking within the second reaction zone. The contacting of the entering material of line 23 with the catalyst at the chosen hydrogenation conditions accordingly results in the production of a mixed phase hydrogenation zone effluent stream carried by line 28 which has a substantially reduced aromatic hydrocarbon content as compared to the material flowing through line 23 but is in other regards highly similar to the material of line 23. The material in line 28 will have a low content of hydrogen sulfide due to the low amount of hydrogen sulfide and organic sulfur in the vapor and liquid streams of lines 22 and 15 respectively.

The material of line 28 is then cooled in the feed-effluent heat exchange means 4 and subjected to further cooling by the indirect heat exchange means 29 before being passed into the product vapor-liquid separator 30. This separator is designed to be effective to separate the entering materials into a liquid phase stream removed through line 31 and passed into a product recovery fractionation means not shown and a vapor phase stream withdrawn through line 32. The vapor phase stream of line 32 will contain some light hydrocarbons but it is still rich in hydrogen and relatively low in hydrogen sulfide. As such it is highly suitable for use in the first reaction zone. As used herein the term "rich" is intended to indicate a concentration of the indicated compound or class of compounds greater than 65 mole percent. A first portion of this gas, preferably from about 35 to 70 volume percent of this gas recovered from the second reaction zone, is passed into the first reaction zone via line 2. The amount of this gas stream can vary between 10 and 70 volume percent of the recovered gas. A remaining second portion is admixed with the gas of line 18 and passed into the treating zone 21 for hydrogen sulfide removal.

The flow of hydrogen and hydrocarbons shown in the drawing is cocurrent through the reaction zones. The practice of the subject invention is however not limited to this manner of operation and the hydrogen-rich gas may flow countercurrent to the liquid-phase hydrocarbons through one or more reaction zones. This can be desired to increase desulfurization effectiveness in the first zone.

The final product stream of the process should contain less than about 5 wt ppm of chemically combined sulfur. The feed to the hydrogenation reactor, the second reaction zone, may contain up to 50 ppm sulfur but preferably contains less than 30 wt ppm sulfur. The desire for a low sulfur content in the feed to the second reaction zone is to promote the aromatic hydrocarbon hydrogenation activity of the platinum-containing hydrogenation catalyst used in the second reaction zone. The unstripped hydrocarbonaceous material in the effluent of the first reaction zone will normally contain a significant amount of $H_2S$. The amount of hydrogen sulfide in the reaction zone effluent is set by the amount of sulfur in the feed and the degree of desulfurization achieved.

Environmentally acceptable levels of aromatic hydrocarbons are much higher than for sulfur. The presently proposed target levels for aromatic hydrocarbons are 10 or 20 volume percent depending upon refinery throughput capacity. The second reaction zone will therefore be operated at conditions such that the diesel boiling range fraction of the effluent contains less than about 10 or 20 wt. percent aromatic hydrocarbons. The second reaction zone could be operated to provide a diesel fuel boiling range product containing less than 5 vol. percent aromatics.

As described above the subject process employs stripping to remove hydrogen sulfide from a process stream prior to the passage of the process stream into downstream reactors. The stripping zone treats the hydrocarbons charged to the second reaction zone The stripping zone is subject to a large degree of mechanical variation and some variation in operating conditions. The stripping zone can basically be any mechanical device which provides adequate countercurrent contacting of the hydrocarbonaceous process streams and a hydrogen-rich stripping vapor. The stripping zone may therefore comprise a vertical pressure vessel containing a bed of suitable packing material A wide variety of such material exists and it is normally a ceramic or metal object of 2 to 12 cm in size which is supported by a screen or other porous liquid collection means located near the bottom of the vessel. Exemplary materials are sold commercially under the trade names of Raschig Rings and Pall Rings. Such packing material is widely described in the literature. Other forms of material which may be employed are the corrugated vertical packing bundles and mesh blanket material often used in fractional distillation columns.

The preferred vapor-liquid contacting structure comprises a plurality, e.g., about 10-15, perforated trays. These trays could have downcomer means similar to classic fractionation trays or they may rely on having relatively large diameter perforations which allow liquid to pass downward simultaneously with the upward gas flow through the perforations. The perforations are preferably circular holes in excess of 0.63 cm (0.25 inch) with the trays having an open area provided by the perforations equal to at least 5 percent of the tray deck area.

The process stream charged to the stripping zone is preferably the entire effluent stream of the upstream reactor. However, the reactor effluent may if desired be separated into vapor and liquid portions, preferably after cooling by heat exchange as shown in the drawing. Only the liquid portion would then be passed into the stripping zone.

The stripping zone is preferably operated at a pressure intermediate that employed in the associated upstream and downstream reaction zones to avoid the need for compressors and the utility costs of operating compressors. The operating pressure in the stripping zone is therefore equivalent to that in the upstream or downstream reactors except for the pressure drops inherent in fluid flow through the intermediate process lines, heat exchanges, valves, etc.

The stripping zone is preferably operated at a lower temperature than the reaction zone to maintain a higher percentage of the hydrocarbonaceous materials including feed, product and by-product hydrocarbons as liquids. It is specifically desired to minimize the content of heavy product distillate hydrocarbons such as diesel fuel in the vapor phase. However, the stripping zone is also operated at a relatively hot temperature well above ambient conditions to promote removal of hydrogen sulfide. Another reason to employ a "hot" stripping zone is to minimize the energy transferred in the cooling and reheating steps needed between the reaction zones and the stripping zone. It is preferred that the stripping zone is operated at a temperature which is from about 100 to 300 Centigrade degrees lower than the effluent temperature of the upstream reactor. A general range of stripping zone operating temperatures is from about 100 to about 300 degrees Centigrade, with a preferred operating temperature range being from 150 to 200 degrees Centigrade.

The stripping gas employed in the subject process is preferably the make-up hydrogen gas fed to the process to maintain the desired hydrogen partial pressure in the controlling reaction zone. A broad range of make-up gas flow rates for the process is from about 53 to about 356 std $m^3/m^3$ (300 to 2000 SCFB). In order to increase stripping vapor rates, a portion of scrubbed recycle gas could, if desired, be used to augment the feed gas.

The subject process is not restricted to the use of specific hydrodesulfurization and hydrogenation catalysts. A variety of different desulfurization and hydrogenation catalysts can therefore be employed effectively in the subject process. For instance, the metallic hydrogenation components can be supported on a totally amorphous base or on a base comprising an admixture of amorphous and zeolitic materials. The nonzeolitic catalysts will typically comprise a support formed from silica-alumina and alumina. In some instances, a clay is used as a component of the nonzeolitic catalyst base. Zeolitic catalysts normally contain one or more of the amorphous materials plus the zeolite.

A finished catalyst for utilization in both the hydodesulfurization zone and the hydrogenation zone should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 250 $m^2/gm$ are greatly preferred.

An alumina component suitable for use as a support in the hydrodesulfurization and hydrogenation catalysts may be produced from any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. A particularly preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

A silica-alumina component may be produced by any of the numerous techniques which are well defined in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier, commonly defined in terms of surface area, pore diameter and pore volume, may be developed to specified limits by any suitable means including aging a hydrosol and/or hydrogel under controlled acidic or basic conditions at ambient or elevated temperature, or by gelling the carrier at a critical pH or by treating the carrier with various inorganic or organic reagents.

The precise physical characteristics of the catalysts such as size, shape and surface area are not considered to be a limiting factor in the utilization of the present invention. The catalyst particles may be prepared by any known method in the art including the well-known oil drop and extrusion methods. The catalysts may, for example, exist in the form of pills, pellets, granules, broken fragments, spheres, or various special shapes such as trilobal extrudates, disposed as a fixed bed within a reaction zone. Alternatively, the catalysts may be prepared in a suitable form for use in moving bed reaction zones in which the hydrocarbon charge stock and catalyst are passed either in countercurrent flow or in co-current flow. Another alternative is the use of fluidized or ebulated bed reactors in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactors in either upward or downward flow.

Although the hydrogenation components may be added to both the hydrodesulfurization and hydrogenation catalysts before or during the forming of the support, hydrogenation components are preferably composited with the catalysts by impregnation after the selected inorganic oxide support materials have been formed, dried and calcined. Impregnation of the metal hydrogenation component into the particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on the preparation of suitable hydrodesulfurization catalysts may be obtained by reference to U.S. Pat. No. 4,422,959; 4,576,711; 4,661,239; 4,686,030; and, 4,695,368 which are incorporated herein by reference.

Hydrogenation components contemplated for the desulfurization catalyst are those catalytically active components selected from Group VIB and Group VIII metals and their compounds. References herein to the Periodic Table are to that form of the table printed adjacent to the inside front cover of Chemical Engineer's Handbook, edited by R. H. Perry, 4th edition, published by McGraw-Hill, copyright 1963. Generally, the amount of hydrogenation components present in the final catalyst composition is small compared to the quantity of the other above-mentioned components combined therewith. The Group VIII component generally comprises about 0.1 to about 30% by weight, preferably about 1 to about 15% by weight of the final catalytic composite calculated on an elemental basis. The Group VIB component comprises about 0.05 to about 30% by weight, preferably about 0.5 to about 15% by weight of the final catalytic composite calculated on an elemental basis. The hydrogenation components contemplated for the desulfurization catalyst include one or more metals chosen from the group consisting of molybdenum, tungsten, chromium, iron, cobalt, nickel, platinum, palladium, iridium, osmium, rhodium, ruthenium and mixtures thereof. The desulfurization catalyst preferably contains two metals chosen from cobalt, nickel, tungsten and molybdenum.

The hydrogenation components of the catalysts will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the desulfurization catalyst. Usually phosphorus is present in the catalyst in the range of 1 to 30 wt. % and preferably 3 to 15 wt. % calculated as $P_2O_5$.

A wide variety of materials described in available references are suitable as hydrogenation catalysts. The hydrogenation catalyst comprises a hydrogenation component comprising one or more noble metals supported on a refractory inorganic oxide base. In this art area the term "noble metal catalyst" is apparently equivalent to platinum group catalyst and the nomenclature may be used interchangeably. The platinum metals, e.g. platinum, rhodium, iridium, ruthenium and palladium, are expected to be the major metal component, although the catalyst may also if desired contain iron, nickel, cobalt, tungsten, or molybdenum. The preferred platinum group metal is platinum. The base material or support is preferably alumina as described above although other materials may be present in admixture with the alumina or the base material may be comprised solely of another material. Examples of such suitable materials are titania or a synthetic zeolitic material having a low cracking activity. Preferably the hydrogenation and the hydrodesulfurization catalysts are both nonzeolitic. Base materials of low acidity such as commonly used in isomerization processes are therefore normally suitable for use as the base material in the hydrogenation zone.

An example of a highly suitable and preferred hydrogenation catalyst is a material containing 0.75 wt. % platinum uniformly dispersed upon 0.16 cm (1/16 inch) spherical alumina. Due to the expensive nature of the noble metals they are used at relatively low concentrations ranging from 0.1 to 1.0 wt. % of the finished composite. Silica may also be used as a support material, but due to its tendency to be acidic it is preferably a lithiated silica or silica which has been treated by some means to reduce its acidity. Another mechanism known in the art for reducing the acidity or cracking tendency of support materials is the passage of ammonia into the reactor in combination with the charge material. The use of this technique is not preferred in the subject process.

More information on the usage and formulation of platinum group metal catalysts for hydrogenation may be obtained by reference to U.S. Pat. Nos. 3,764,521; 3,451,922; and 3,493,492 and the references cited above. The high cost of the noble metals has led to efforts to seek substitutes. Specifically, in U.S. Pat. No. 3,480,531 issued to B. F. Mulaskey there is described a catalyst comprising between 5 and 30 wt. % combined nickel and tin. This material is preferably supported on a lithiated silica and it is described as being suitable for the hydrogenation of jet fuel fractions derived from hydrocracking to increase the smoke point of the jet fuel and render it highly paraffinic.

It is preferred that the catalyst(s) used in the first reaction zone is essentially free of any noble metal such as platinum or palladium. It is also preferred that the second reaction zone is essentially free of non-noble metal catalysts.

The hydrogenation of distillate fractions such as kerosene is addressed in European Patent Office Publication 303332 of Feb. 15, 1989, based upon Application 88201725.4 assigned to Shell International Research MIJ BV, which is incorporated herein by reference for its description of hydrogenation catalyst and methods. A specific usage of the catalyst of that application is the increase in cetane number of a cycle oil and the hydrogenation of kerosene for smoke point improvement without substantial hydrocracking. The catalyst comprises a Group VIII metal on a support comprising a modified Y-type zeolite of unit cell size 24.20–24.30 Angstroms and a silica to alumina mole ratio of at least 25 e.g. 35–65. Platinum or palladium on a dealuminated Y zeolite is an exemplary catalyst. Hydrogenation is performed at 225-300 degrees C. at a hydrogen partial pressure of 30-100 bar. Catalysts suitable for use in both the desulfurization and the hydrogenation reaction zones are available commercially.

A study of the conditions useful in the saturation of diesel fuel aromatics, the effects of varying these conditions on the products, product properties and other factors involved in using a specific commercially available hydrogenation catalyst is presented in the previously cited article at page 47 of the May 29, 1989 edition of the *Oil and Gas Journal*. A second article on the production of low aromatic hydrocarbon diesel fuel is present at page 109 of the May 7, 1990 edition of the *Oil and Gas Journal*. These articles are incorporated herein by reference for its teaching in regard to the hydrogenation of middle distillates. The second article addresses catalyst compositions suitable for use in the presence of sulfur.

It may be noted from the drawing that the liquid effluent stream of the stripping zone is reheated to the desired inlet temperature of the downstream reaction zones by use of only the heat obtained by indirect heat exchange. While a heater could be employed to supplement the available heat, it is a preferred feature of the subject invention that no such heater is required. The absence of any fired heater reduces the utility and capital costs of the process. To accomplish the objective of providing an economical process, there is maintained a descending temperature gradation between the two reaction zones. The effluent temperature of the first reaction zone is preferably sufficiently high to heat the combined charge stock to the desired inlet temperature of the second reaction zone.

The reaction zone temperature gradation is best measured by comparing the outlet temperature of a reaction zone with inlet temperature requirement for the succeeding reaction zone. That is, the first reaction zone outlet temperature must be greater than the second reaction zone inlet temperature by an appropriate temperature gradation. It is preferred that this temperature gradation be at least 10 Centigrade degrees and more preferably over 25 Centigrade degrees.

In comparison there is a positive pressure gradation between reaction zones. When combined with the preferred increasing pressure profile between reaction zones, the result is that the operating temperature of the first reaction zone is greater than the operating temperature of the second reaction zone while the operating pressure of the second reaction zone is greatest. This is to achieve gas flow through the first reaction zone without the use of a compressor other than the recycle compressor. It is therefore necessary to pump liquid into the second reaction zone from the first reaction, with the pump being located for instance at the outlet of the stripper 12. The pressure in the first reaction zone may be greater than that in the second, but this is not preferred as it would be necessary to then compress the hydrogen-rich gases into the first reaction zone.

The hydrogen-rich gas stream recovered from the effluent of the hydrogenation zone is separated into at least two fractions. One fraction forms a portion of the hydrogen recycle gas for the hydrogenation zone. The remaining portion preferably is passed into the desulfurization zone. This allows facile independent control of the hydrogen flow rates in the two reaction zones, and again this flexibility is achieved with a single compressor within the process loop.

Hydrogenation conditions and desulfurization conditions used in the subject process are somewhat related. This is due in part to the interconnection between the zones and use of the upstream effluent to heat the feed to the hydrogenation zone. With a primary objective of saturating aromatic hydrocarbons, it must be noted that the operating pressure and temperature required for aromatics saturation will set the operating conditions in the hydrogenation zone. This will greatly influence conditions used for desulfurization. The pressure range (hydrogen partial pressure) for the hydrogenation zone ranges broadly from about 400-1,800 psia (2,758-12,411 kPa). The hydrogenation zone is preferably operated at a higher liquid hourly space velocity than the hydrodesulfurization zone. A liquid hourly space velocity of 0.5 to 4.5 is preferred. Again, operating conditions will be highly dependent on the feedstock composition. The hydrogenation zone is preferably operated with a hydrogen to hydrocarbon ratio of about 5,000 to 18,000 std. cubic feet hydrogen per barrel of feedstock (889 to 3200 std. meter$^3$ per meter$^3$). The hydrogenation zone may be operated at a temperature of about 450 to 700 degrees F. (232-371° C.).

A typical feed stream is the blend of straight run diesel, coker distillate and FCC light cycle oil having the properties set out in Table 1. An objective of the operation of the invention is the conversion of such a feed stream into a diesel fuel having relatively low sulfur and aromatic hydrocarbon contents.

TABLE 1

| Feed Properties | |
|---|---|
| °API | 29.4 |
| Sp. Gravity | 0.8797 |
| Wt. % Sulfur | 1.73 |
| Total N, ppm | 660 |
| Aromatics, Vol. % | 39.0 |
| $C_7$ Insol, wt. % | <0.05 |
| Ni & V, wt. ppm | 0.4 |
| Initial BP °C. | 215 |
| 50% BP °C. | 280 |
| 90% BP | 304 |
| End BP °C. | 338 |

One embodiment of the invention may be characterized as a process for producing a low sulfur and low aromatic hydrocarbon content distillate hydrocarbon product which comprises the steps of passing a feed stream comprising an admixture of distillate boiling range hydrocarbons having boiling points above about 140 degrees Centigrade and a first hydrogen stream into a desulfurization reaction zone maintained at desulfurization conditions and producing a desulfurization zone effluent stream comprising hydrogen, hydrogen sulfide, $C_2$-$C_4$ byproduct hydrocarbons and distillate boiling range hydrocarbons; stripping hydrogen sulfide from the desulfurization reaction zone effluent stream by countercurrent contact with a second hydrogen stream and producing: (1) a stripped hydrocarbon process stream and (2) a stripping zone net vapor stream; passing the stripped hydrocarbon process stream and a third hydrogen stream into a hydrogenation reaction zone containing a hydrogenation catalyst maintained at hydrogenation conditions and producing a hydrogenation reaction zone effluent stream which comprises product distillate hydrocarbons and hydrogen; recovering hydrogen-rich gas and product distillate hydrocarbons from the hydrogenation zone effluent stream; passing a first portion of hydrogen-rich gas recovered from the hydrogenation zone effluent stream into the desulfurization reaction zone as at least a portion of said first hydrogen stream; and removing hydrogen sulfide from at least a portion of the stripping zone net vapor stream, and passing at least a portion of the resultant treated gas stream and a second portion of the hydrogen-rich gas recovered from the hydrogenation zone effluent stream into the hydrogenation reaction zone as said third hydrogen stream.

The invention may also be characterized as a process for producing a low sulfur and low aromatic hydrocarbon content distillate hydrocarbon product which comprises the steps of passing a feed stream comprising an admixture of distillate boiling range hydrocarbons having boiling points above about 140 degrees Centigrade and a first hydrogen stream into a desulfurization reaction zone maintained at desulfurization conditions including a first inlet temperature and a first pressure and producing a desulfurization zone effluent stream comprising hydrogen, hydrogen sulfide, $C_2$-$C_4$ byproduct hydrocarbons and distillate boiling range hydrocarbons; stripping hydrogen sulfide from the desulfurization reaction zone effluent stream by countercurrent contact with a second hydrogen stream and producing: (1) a stripped hydrocarbon process stream and (2) a stripping zone net vapor stream; heating an admixture of the stripped hydrocarbon process stream and a third hydrogen stream to a desired second inlet temperature by indirect heat exchange against the desulfurization zone effluent stream; passing an admixture of the stripped hydrocarbon process stream and the third hydrogen stream into a hydrogenation reaction zone containing a hydrogenation catalyst maintained at hydrogenation conditions including the second inlet temperature and a second pressure and producing a hydrogenation reaction zone effluent stream which comprises distillate hydrocarbons and hydrogen; recovering product distillate hydrocarbons and a hydrogen-rich gas from the hydrogenation zone effluent stream; passing a first portion of the hydrogen-rich gas stream recovered from the hydrogenation zone effluent stream into the desulfurization reaction zone as at least a portion of said first hydrogen stream; and removing hydrogen sulfide from at least a portion of the stripping zone net vapor stream and from a second portion of the hydrogen-rich gas stream recovered from the hydrogenation zone effluent stream and passing at least a portion of the resultant treated gas stream into the hydrogenation reaction zone as said third hydrogen stream.

What is claimed:

1. A hydrotreating process which comprises the steps:

a) passing a stream of middle distillate charge stock into the first of at least two reaction zones and producing a first reaction zone effluent, the two reaction zones comprising a first catalytic reaction zone containing a fixed bed of solid desulfurization catalyst comprising a non-noble metal active component chosen form the group comprising cobalt, molybdenum, nickel and tungsten and maintained at desulfurization conditions, and a second reaction zone containing a fixed bed of hydrogenation catalyst comprising a platinum group active component and maintained at hydrogenation conditions which include a higher pressure and lower temperature than the first reaction zone;

b) separating the first reaction zone effluent into liquid and vapor fractions and stripping the liquid fraction with hydrogen in a stripping zone operated at stripping conditions including a temperature of 150 to 200 degrees C. to produce a first stripping zone gas stream, and then heating the resultant liquid fraction by indirect heat exchange against the first reaction zone effluent stream at a point prior to said separation of the first reaction zone effluent;

c) removing hydrogen sulfide from the first stripping zone gas stream, and passing the first stripping zone gas stream into the second reaction zone;

d) passing the liquid fraction of the effluent of the first reaction zone into the second reaction zone after heating from stripping conditions by indirect heat exchange against the first reaction zone effluent and producing a second reaction zone effluent; and, e) separating hydrogen-rich gas from the second reaction zone effluent and passing portions of hydrogen-rich gas separated from the second reaction zone effluent directly into both the first and the second reaction zones, and recovering a reduced aromatic hydrocarbon content product stream from the effluent of the second reaction zone.

2. The process of claim 1 wherein the charge stock comprises gas oil boiling range hydrocarbons.

3. The process of claim 1 wherein the charge stock comprises diesel fuel boiling range hydrocarbons.

4. The process of claim 3 wherein the hydrogenation catalyst comprises platinum.

5. The process of claim 4 wherein the second reaction zone is operated at a higher space velocity and higher hydrogen recycle rate than the first reaction zone.

6. A process for producing a low sulfur and low aromatic hydrocarbon content distillate hydrocarbon product which comprise the steps of:

(a) passing a feed stream comprising an admixture of distillate boiling range hydrocarbons having boiling points above about 140 degrees Centigrade and a first hydrogen stream into a desulfurization reaction zone maintained at desulfurization conditions including a first inlet temperature and a first pressure and producing a desulfurization zone effluent stream having a first outlet temperature comprising hydrogen, hydrogen sulfide, $C_2$-$C_4$ byproduct hydrocarbons and distillate boiling range hydrocarbons;

(b) stripping hydrogen sulfide from the desulfurization zone effluent stream by countercurrent contact with a second hydrogen stream at stripping conditions which include an elevated temperature of about 100 to about 300 degrees Centigrade and producing:

(1) a stripped hydrocarbon process stream and (2) a stripping zone net vapor stream;

(c) heating an admixture of the stripped hydrocarbon process stream and a third hydrogen stream to a desired second inlet temperature by indirect heat exchange against the desulfurization zone effluent stream;

(d) passing said admixture of the stripped hydrocarbon process stream and the third hydrogen stream into a hydrogenation reaction zone containing a hydrogenation catalyst maintained at hydrogenation conditions including the second inlet temperature and a second pressure and producing a hydrogenation reaction zone effluent stream which comprises distillate hydrocarbons and hydrogen;

(e) recovering product distillate hydrocarbons from the hydrogenation zone effluent stream; passing a first portion of a hydrogen-rich gas stream recovered from the hydrogenation zone effluent stream into the desulfurization reaction zone as at least a portion of said first hydrogen stream; and (f) removing hydrogen sulfide from at least a portion of the stripping zone net vapor stream and from a second portion of the hydrogen-rich gas stream recovered from the hydrogenation zone effluent stream and passing at least a portion of the resultant treated gas stream into the hydrogenation reaction zone as said third hydrogen stream.

7. The process of claim 6 wherein the first portion of the hydrogen-rich gas stream recovered from the hydrogenation zone effluent stream is equal to about 10 to 70 volume percent of the total hydrogen-rich gas recovered from the hydrogenation zone effluent stream.

8. The process of claim 6 wherein the first outlet temperature is greater than the second inlet temperature, and wherein the second pressure is greater than the first pressure.

9. The process of claim 6 wherein the desulfurization reaction zone contains a bed of catalyst comprising molybdenum and the hydrogenation reaction zone contains a bed of hydrogenation catalyst comprising platinum.

10. The process of claim 9 wherein the admixture of the stripped hydrocarbon process stream and the third hydrogen stream contains less than 50 wt. ppm sulfur.

11. The process of claim 6 wherein hydrogen flows cocurrently with the reactants in each reaction zone.

12. The process of claim 6 wherein the charge stock comprises diesel fuel boiling range hydrocarbons.

* * * * *